US006511261B2

(12) United States Patent
de Waard et al.

(10) Patent No.: US 6,511,261 B2
(45) Date of Patent: Jan. 28, 2003

(54) METHOD OF REMOVING OR POSITIONING A SUBSTRUCTURE OF AN OFFSHORE PLATFORM

(75) Inventors: Onno Ludolf de Waard, Warmond (NL); Richard Petrus Gerhardus Zoontjes, Delft (NL); Jan Molenaar, Sassenheim (NL)

(73) Assignee: Heerema Marine Contractors Nederland B. V., Leiden (NL)

( * ) Notice: Subject to any disclaimer, the term of this patent is extended or adjusted under 35 U.S.C. 154(b) by 7 days.

(21) Appl. No.: 09/778,379

(22) Filed: Feb. 7, 2001

(65) Prior Publication Data

US 2001/0018009 A1 Aug. 30, 2001

(30) Foreign Application Priority Data

Feb. 8, 2000 (NL) ..... 1014314

(51) Int. Cl.[7] ..... B63B 35/00

(52) U.S. Cl. ..... 405/204; 405/209; 114/51; 114/259

(58) Field of Search ..... 405/203, 204, 405/205, 209; 114/258, 259, 265, 51

(56) References Cited

U.S. PATENT DOCUMENTS

| | | | | |
|---|---|---|---|---|
| 3,054,267 A | * | 9/1962 | Alcorn et al. | 405/209 |
| 3,859,806 A | | 1/1975 | Guy et al. | |
| 4,705,430 A | * | 11/1987 | Will | 405/204 X |
| 4,973,199 A | | 11/1990 | Cox | |

FOREIGN PATENT DOCUMENTS

| | | |
|---|---|---|
| WO | WO 90/03470 | 5/1990 |

* cited by examiner

*Primary Examiner*—Heather Shackelford
*Assistant Examiner*—Sunil Singh

(57) ABSTRACT

The method for removing or positioning a structure (103) which is erected on either an underwater bed or anchored to the underwater bed entails the use of a hoisting mechanism. When the structure (103) is being removed, it is detached from the underwater bed. Then, the structure (103) is connected to a hoisting mechanism which is arranged on a separate hoisting vessel (100). The structure is hoisted up by the hoisting mechanism and is attached to a transport vessel (1) in such a manner that it can tilt about a horizontal axis. Then, the structure is tilted into a substantially horizontal position. The structure is positioned in the reverse order.

16 Claims, 7 Drawing Sheets

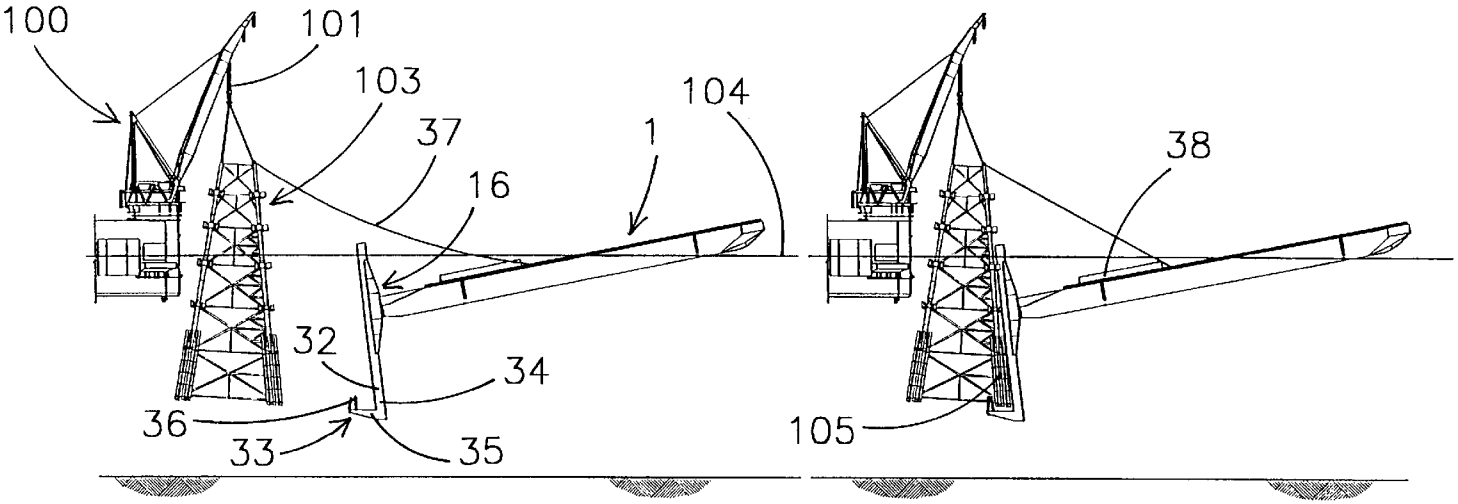
Fig 10
Fig 11
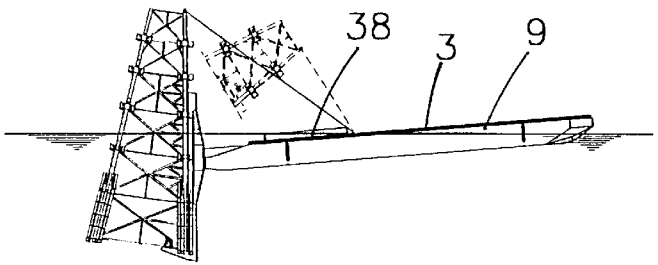
Fig 12
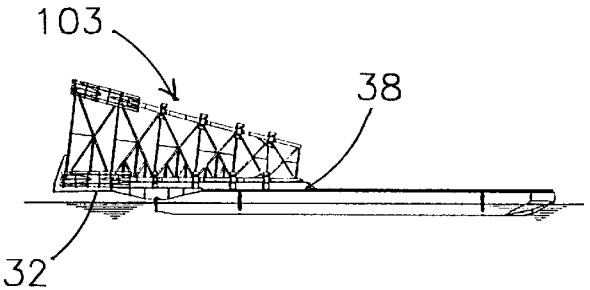
Fig 13

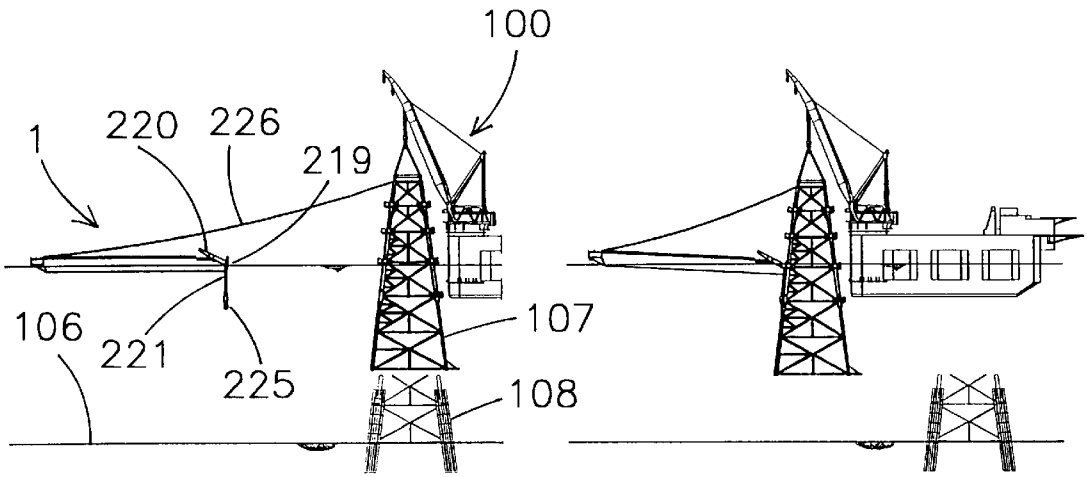
Fig 15
Fig 16
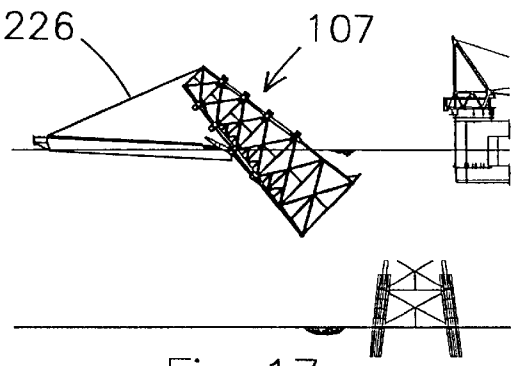
Fig 17
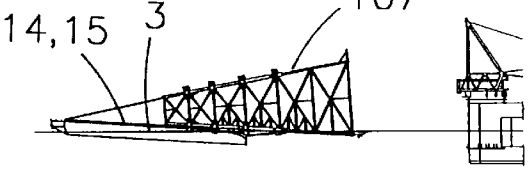
Fig 18
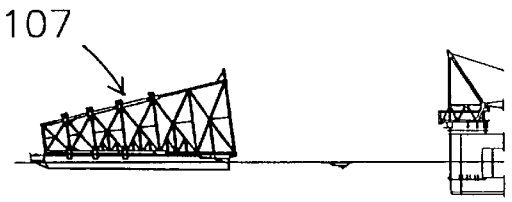
Fig 19

METHOD OF REMOVING OR POSITIONING A SUBSTRUCTURE OF AN OFFSHORE PLATFORM

FIELD OF THE INVENTION

The invention relates firstly to a method for removing a structure or a part of a structure which is erected on an underwater bed or anchored to the underwater bed. The invention also relates to a method for positioning a structure or a part of the structure on an underwater bed or anchoring it to the underwater bed.

BACKGROUND OF THE INVENTION

In practice, structures positioned in the sea, such as offshore platforms, are constructed from a substructure which is erected on the seabed or floats on the surface, in which case it is anchored to the seabed, including, for example, substructures of so-called "Spar" and "tension-leg" platforms, and a superstructure which comprises a deck provided with deck modules. When a structure of this type is being positioned, the substructure is positioned first, after which the unitary superstructure is arranged thereon. In a known method the substructure is positioned by tilting the substructure, which lies approximately horizontally on a transport and hoisting vessel, into the water via a tilting device and then lowering it in an approximately vertical position. In a known method for removal of a structure using the same vessel, the superstructure is removed first, after which the substructure is completely or partially removed. The substructure is hoisted upwards using a hoisting mechanism arranged on the transport vessel itself and is then placed horizontally on the vessel via the tilting device.

The drawback of a method of this type is that the hoisting means for lowering or raising the substructure are arranged on the transport vessel itself. This requires additional structural measures on the vessel, leading to a more expensive vessel.

An alternative solution for positioning the substructure is shown in WO 90/03470. This publication does not disclose a hoisting mechanism, but rather a submersible barge which is tiltably connected to a transport vessel. The submersible barge is provided with ballast tanks which can be filled with air or water in order to raise or lower the substructure when connected to the barge. This solution also has the drawback that a complicated structure is required on the transport vessel.

The object of the invention is to provide a method which allows the transport vessel to be of more simple design.

SUMMARY OF THE INVENTION

The object of the invention is achieved by hoisting or lowering the structure using a separate hoisting vessel on which the hoisting mechanism is arranged. For example, it is possible for an existing crane ship to be used. This has the advantage that the transport vessel does not have to have specially developed hoisting means, and consequently costs are saved. An additional advantage is that the hoisting means may also be used for other purposes.

The transport vessel for use in this method is preferably designed with attachment means which comprise at least one tiltable arm which is provided with suspension means which can act on the structure.

In a preferred embodiment the suspension means comprise a suspension hook. The suspension hook is situated above the surface of the water. For example when being removed, the structure is hoisted upwards by the hoisting vessel, after which the suspension hook can engage thereon. The advantage of this is that the suspension hook engages on a part of the structure which is situated above water and can therefore easily be checked for strength beforehand.

In another embodiment the suspension means comprise a support foot which can act on a lower part of the structure. The advantage of this support foot is that it can act on a lower and more sturdy section of the structure, so that the risk of the structure collapsing when it is being raised or lowered is reduced.

In a third embodiment a second tiltable arm is connected to one end of the at least one tiltable arm, resulting in a tilting mechanism with two tilting points, which has the advantage that the structure is well supported through the entire tilting movement. Furthermore, in this embodiment of the attachment means the suspension means can comprise cables which are arranged on the transport vessel on the side of the tilting arms and hang downwards from the vessel. The lower ends of the cables are provided with attachment members for acting on a part of the structure which is to be positioned or removed. The advantage of this is that the length of the cables can be easily adapted, so that the location of engagement on the structure is easy to vary and any desired part of the structure can be supported and taken away.

BRIEF DESCRIPTION OF THE DRAWINGS

The method according to the invention will be explained in more detail below with reference to the drawing, in which:

FIGS. 10–13 show, in a number of steps, the method for removing a structure which is erected underwater with the aid of a system in which the transport vessel is equipped with a second embodiment of the attachment means;

FIGS. 15–19 show, in a number of steps, the removal of a structure which is erected underwater with the aid of a system in which the transport vessel is equipped with a third embodiment of the attachment means.

DETAILED DESCRIPTION OF THE INVENTION

Figure 1:
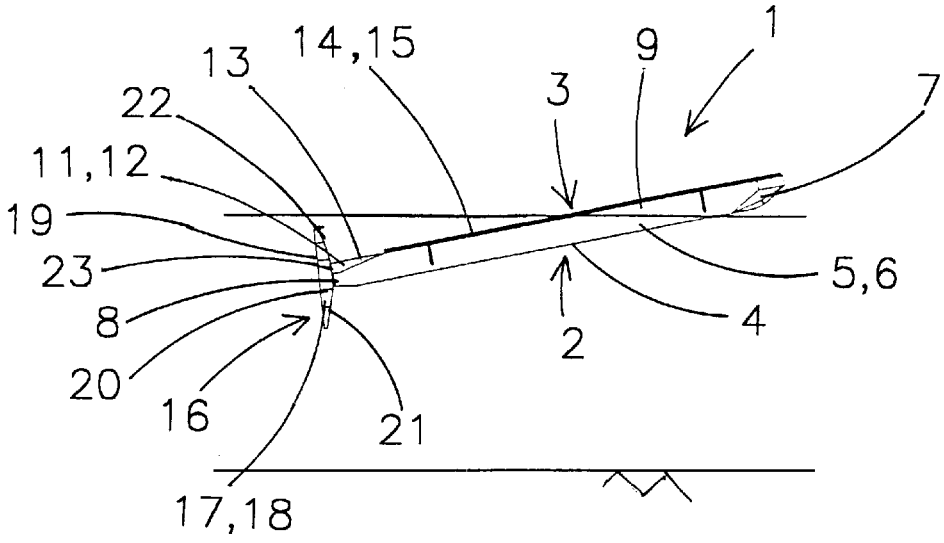
FIG. 1 shows a side view of a transport vessel provided with tilting arms.

FIG. 1 shows a transport vessel 1. The transport vessel 1 comprises a bottom section 2 and a transport deck 3.

The bottom section 2 comprises a bottom 4 and longitudinal walls 5, 6. At one end of the vessel 1 is a bow 7. At the opposite end is a stern 8.

At the rear of the transport vessel 1, in the transport deck 3, there are two recesses 11, 12 where the deck slopes and adjoins the stern 8. The recesses 11, 12 are separated by a deck section 13 which runs horizontally.

Guide bars 14, 15 are arranged on either side of the transport deck 3, in the longitudinal direction.

The transport vessel 1 is substantially symmetrical with respect to a plane which runs in the longitudinal direction of the vessel and is perpendicular to the deck surface. Inside, there are various compartments which serve as ballast tanks which can be filled with water in order to ensure that the transport vessel 1 partially sinks or out of which water can be pumped in order to raise the transport vessel.

At the stern there are tiltable attachment means 16. These attachment means 16 comprise at least two tilting arms 17, 18. The tilting arms 17, 18 are of elongate form, one side, in the longitudinal direction of the arm, being planar and the opposite side, in the longitudinal direction, having a central section and two inclined sections which, from the central section, run obliquely towards the end of the tilting arm 17, 18, with the result that the ends of the arms 17, 18 are narrower than the centre. The inclined sections of the tilting arms 17, 18 are formed in such a manner that they are complementary with the recesses 11, 12 in the deck, so that the planar side lies in line with the deck of the vessel 1 when one of the inclined sides bears against the inclined surface of the deck recess.

The tilting arms 17, 18 are each rotatably connected to the stern 8 of the vessel 1 by means of a pivot which is arranged in the central section of the tilting arm and is attached to the stern 8 at the end of the sloping surface of the recess in the deck section of the vessel. The pivot connection allows that, in operation, the tilting arms 17, 18 can be tilted between an upright position and a horizontal position with respect to the deck of the vessel.

Figure 2:
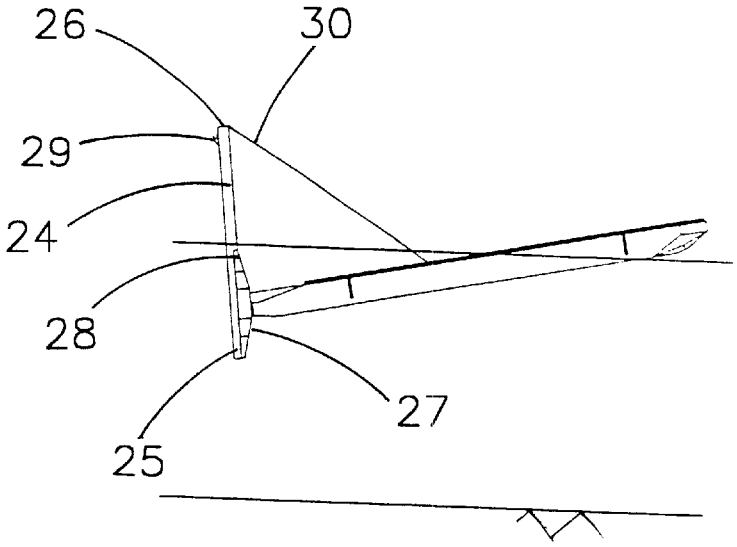
FIG. 2 shows a side view of a transport vessel provided with a first embodiment of the attachment means.

FIG. 2 shows a preferred embodiment, in which an extension bar 24 is attached to each tilting arm 17, 18. The length of the extension bar 24 is greater than that of the tilting arm 17, 18. One end 25 of the extension bar 24 is situated at approximately the same level as the bottom end 27 of the upright tilting arm 17, 18, with the result that the top end 26 of the extension bar 24 projects above the top end 28 of the tilting arm 17, 18.

Figure 3:
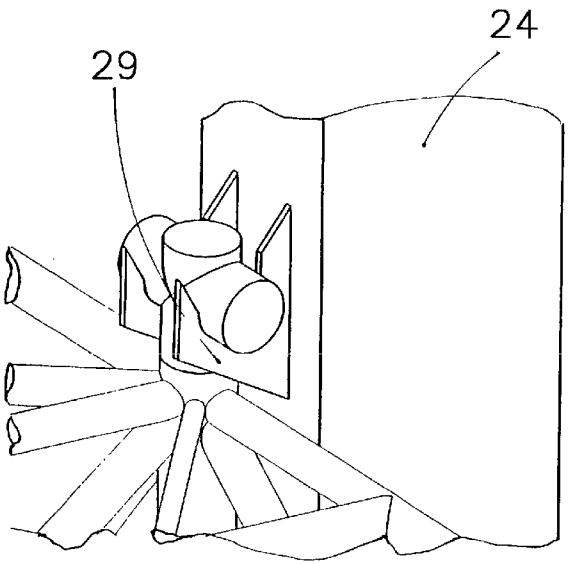
FIG. 3 shows a perspective view of a part of the embodiment of the attachment means shown in FIG. 2.

In the vicinity of the top end thereof, the extension bars 24 are each provided with a suspension hook 29. FIG. 3 shows a hook 29 of this type in detail, and the action of this hook 29 will be described further below.

A hauling cable 30, which can be wound in or paid out for example by means of a winch (not shown) situated on the transport vessel 1, is attached to the top end of the extension bars 24.

The way in which the attachment means 16 with the extension bars 24 operate when a substructure 103 of an offshore platform is being removed will be explained with reference to FIGS. 4–8.

Figure 4:
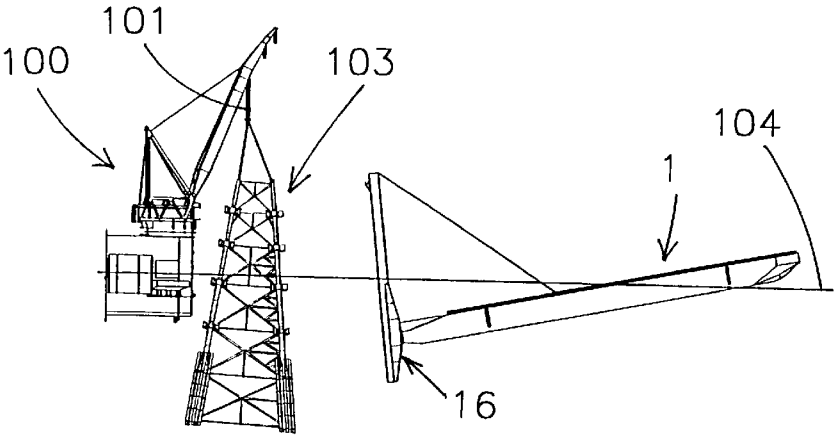
Figure 5:
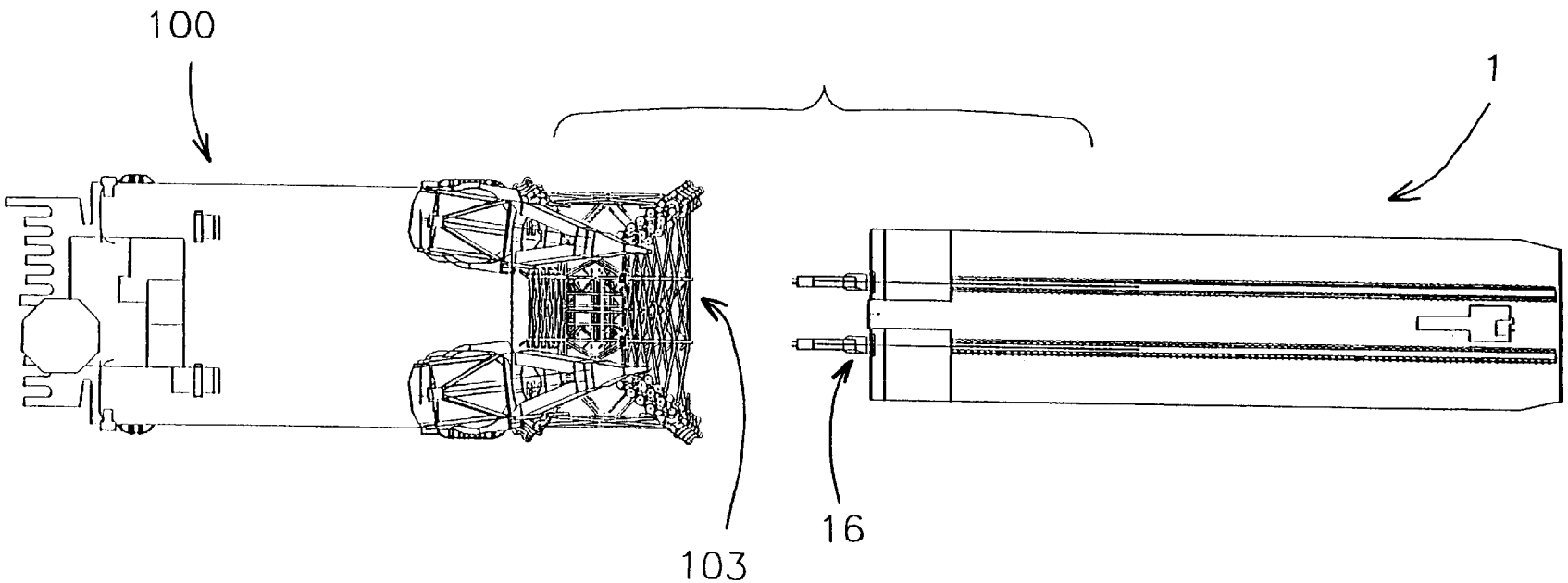

FIG. 4 and FIG. 5 show a separate hoisting vessel 100, with a substructure 103 of an offshore platform hanging from the hoisting cable 101, the substructure 103 being situated partially under water. The substructure 103 has internal ballast compartments which can be emptied. The substructure 103 is then subjected to an upward force on account of the surrounding water, with the result that the load on the hoisting vessel 100 is reduced when raising the substructure 103. The attachment means 16 of the transport vessel 1 are turned towards the hoisting vessel 100 with the substructure 103. The tilting arms 17, 18 are moved into a substantially vertical position. Then, water is allowed into the ballast tanks of the transport vessel 1, so that it partially sinks and the end with the attachment means 16 moves below the water surface 104. The tilting arms 17, 18 are completely or partially under water, while the extension bars 24 remain largely above the water, the suspension hooks 29 being situated at the end above the surface 104 of the water.

In a subsequent step (FIG. 6), the hoisting vessel 100 and the transport vessel 1 are moved towards one another. The extension bars 24 and the substructure 103 are placed against one another. The suspension hooks 29 are then hooked behind a suitable, sturdy part of the substructure 103, as a result of the substructure 103 being lowered by means of the hoisting mechanism 100 so that the substructure 103 is suspended in the hooks 29. Another possible option is for the rear side of the transport vessel 1 to be raised slightly by pumping ballast out of the ballast tanks, so that the suspension hooks 29 engage on and lift the substructure 103. It is also possible for, either simultaneously or successively, both the substructure 103 to be lowered and the transport vessel 1 to be raised in order to allow the suspension hooks 29 to engage on the substructure 103. When the substructure 103 is completely hanging from the suspension hooks 29, the hoisting cable 101 is uncoupled and the hoisting vessel 100 is removed.

Figure 7:
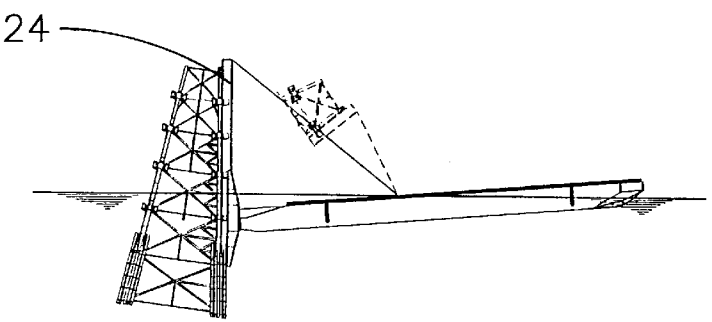

The substructure 103 is suspended from the suspension hooks 29 on the extension bars 24, in such a manner that the hauling cable 30 remains under tension. The substructure 103 is tilted towards the transport deck 3 of the transport vessel 1 as a result of the hauling cable 30 being wound in using the winch (FIG. 7). Tilting of the substructure 103 can be facilitated by emptying ballast tanks situated in the substructure 103. When the attachment means 16 together with the load have been tilted completely onto the transport deck 3, that side of the transport vessel 1 on which the attachment means 16 are situated can be raised by emptying the ballast tanks of the transport vessel 1. When the transport deck 3 together with the attachment means 16 and the substructure 103 are completely above the surface 104 of the water (FIG. 8), the substructure 103 can be fixed to the transport vessel 1 in order to be transported.

Figure 9:
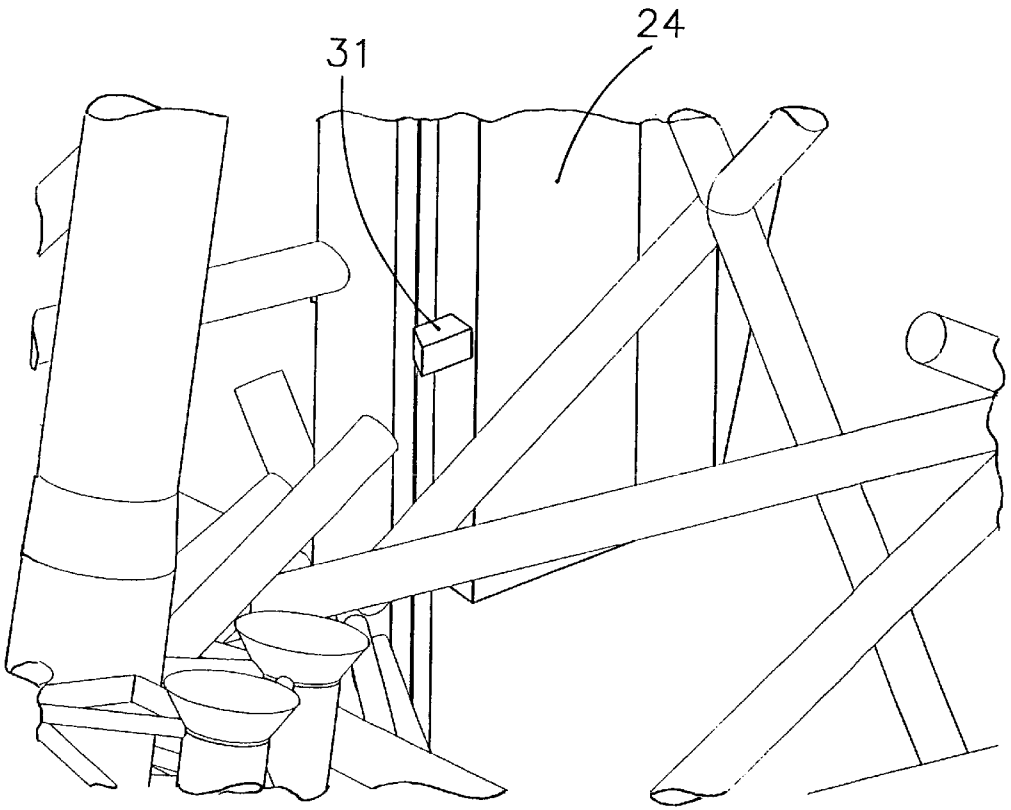
FIG. 9 shows a guide which is arranged on the attachment means.

To provide the substructure 103 with lateral support during tilting and during transport, side guides 31, which are shown in FIG. 9, are arranged on the extension bars 24.

Another embodiment of attachment means 16 with extension bars is shown in FIG. 10. In this embodiment, the attachment means 16 are provided with downwardly projecting extension bars 32, each of the extension bars 32 being provided with a bearing foot 33. In the upright position of the extension bar 32 connected to the tilting arm 17, 18, this bearing foot 33 is at the bottom end 34 of the extension bar 32.

The bearing foot 33 comprises a support part 35 which is substantially perpendicular to the extension bar 32 and is provided with an upright edge 36 at the free end. The extension bar 32 is of a greater length than the tilting arm 17, 18 and is connected to the tilting arm 17, 18 in such a manner that, in the upright position, the bottom end is situated beneath the bottom end of the tilting arm 17, 18.

The way in which this embodiment of the attachment means 16 with extension bars 32 operates when removing a substructure 103 of an offshore platform will be explained with reference to FIGS. 10–13.

FIG. 10 shows that the substructure 103 is hanging from the hoisting cable 101 of a separate hoisting vessel 100, the substructure 103, for the reasons mentioned above, being partially under water. A hauling cable 37 is attached to the top of the hanging substructure 103. This hauling cable 37 is connected to a winch on the transport vessel 1. On account of water in the ballast tank, the end of the transport vessel 1 which is provided with the attachment means 16 is below the water level 104.

The hoisting vessel 100 and the transport vessel 1 are moved towards one another. The extension bars 32 and the substructure 103 are placed against one another, the bearing foot 33 being arranged in each case beneath one of the legs 105 of the substructure 103. The bearing foot 33 is then brought into engagement with the leg 105 as a result of the transport vessel 1 being moved upwards slightly as a result of water being pumped out of the ballast tanks. If appropriate, the hoisting vessel 100 may also lower the substructure 103 onto the bearing foot 33. Then, the hauling cable 37 can be wound in by the winch and tensioned. The centre of gravity of the attachment means 16 together with the substructure 103 is positioned in such a manner that the hauling cable 37 remains under tension throughout the entire tilting movement.

The substructure 103 is then moved upwards by the transport vessel 1 as a result of the ballast tanks in the vessel 1 being emptied further. As a result of the hauling cable 37 being wound in using the winch, the substructure 103 together with the attachment means 16 is tilted towards the transport deck 3 (FIG. 12). FIG. 13 shows how the substructure 103 rests on the extension bars 32 and support bars 38 arranged on the transport deck 3. The transport deck 3 and the attachment means 16 of the transport vessel 1 are now completely above water. The substructure 103 can then be further secured to the vessel 1 for transport purposes.

Figure 14:
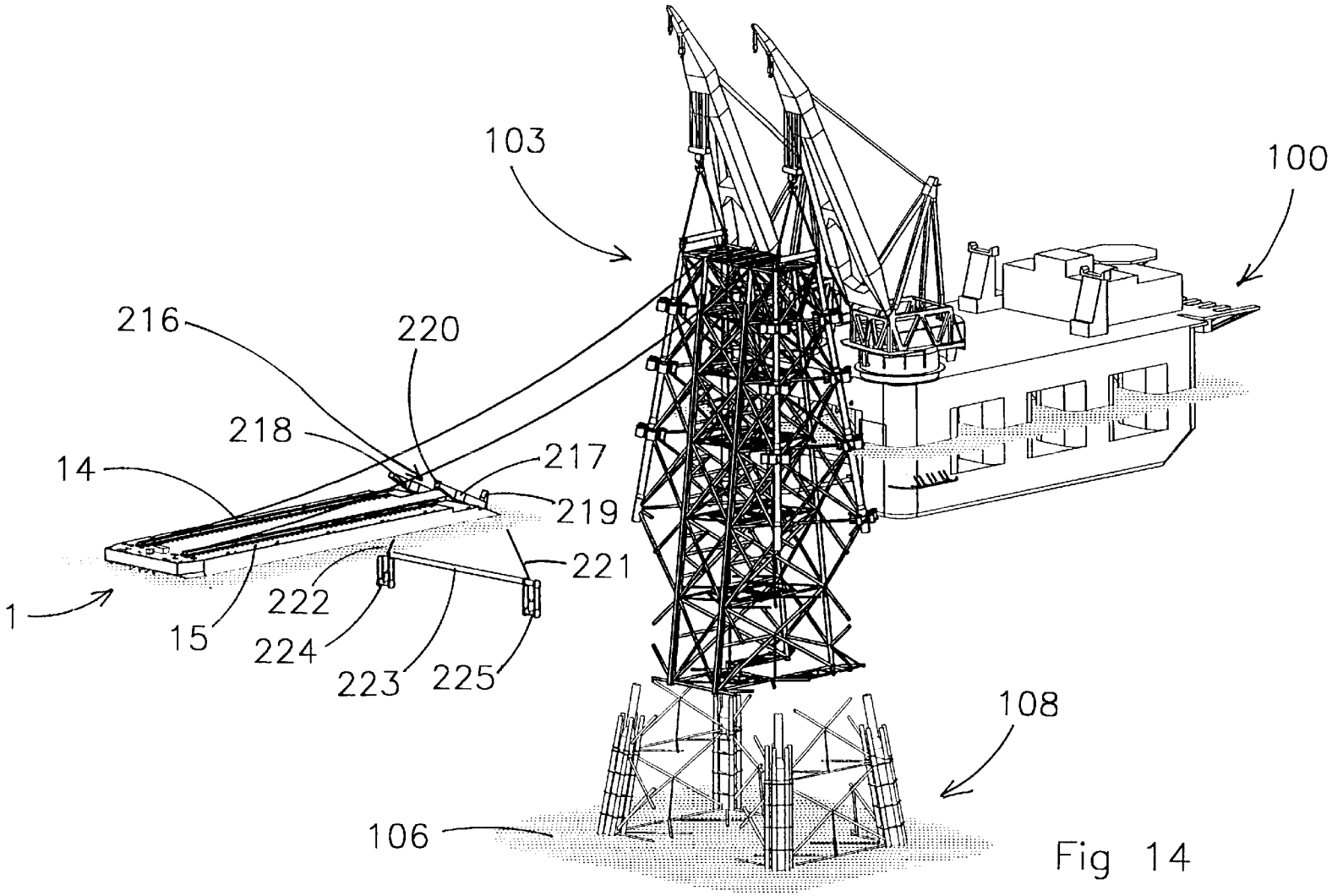
FIG. 14 shows a perspective view of a system in which the transport vessel is equipped with a third embodiment of the attachment means.

An alternative embodiment of the attachment means is shown in FIG. 14. The attachment means 216 comprise two sets of tilting arms. A first and a second set of tilting arms 217, 218 and 219, 220, respectively, are pivotably connected to the vessel.

Cables 221, 222, which hang below the surface 104 of the water, are attached to the vessel in the region of the sets of tilting arms. The lower end of the cables 221, 222 are connected to a rod 223, so that a trapeze-like device is formed. Attachment members 224, 225 are arranged on the rod 223 and are used to secure the rod 223 to a suitable part of the substructure 103 of the offshore platform.

This embodiment is particularly suitable for removing a part of a substructure 103. FIGS. 15–19 show how this takes place.

FIGS. 14 and 15 show how an upper substructure section 107 of the substructure 103 which has been detached from a part 108 arranged on the seabed 106 is held up by a hoisting vessel 100. Between the transport vessel 1 and the upper substructure section 107 there is a hauling cable 226 which can be wound in, for example by means of a winch arranged on the transport vessel 1. In FIG. 16, the upper substructure section 107 has been placed against the attachment means 16 of the transport vessel 1 by the hoisting vessel 100. The attachment members 224, 225 are connected to the substructure section 107 at a suitable, sturdy location. A vertical long side of the tilting arms 219, 220 is placed against the substructure section 107. The tilting arms 217, 218 have been tilted into an inclined position which is between a vertical and a horizontal position. FIG. 17 shows how the hauling cable 226 is wound in, with the result that the substructure section 107 together with the second set of tilting arms 219, 220 is tilted towards the transport deck 3. When the substructure section 107 has been tilted sufficiently far, it will come to rest against a long side of the first set of tilting arms 217, 218. The substructure section 107 will then tilt about the pivot between the vessel 1 and the first set of tilting arms 217, 218, until the substructure section 107 rests partially on the guides 14, 15 on the transport deck 3 of the transport vessel 1, as shown in FIG. 18. Then, the substructure section 107, via the guides 14, 15, can be placed entirely on the transport deck 3 (see FIG. 19), after which it can be fixed to the transport vessel 1 and can be transported.

With reference to FIGS. 4–8 in the reverse order, it is possible to explain how a transport vessel 1 with attachment means can be used to transport and position a substructure of an offshore platform on a seabed.

Figure 6:
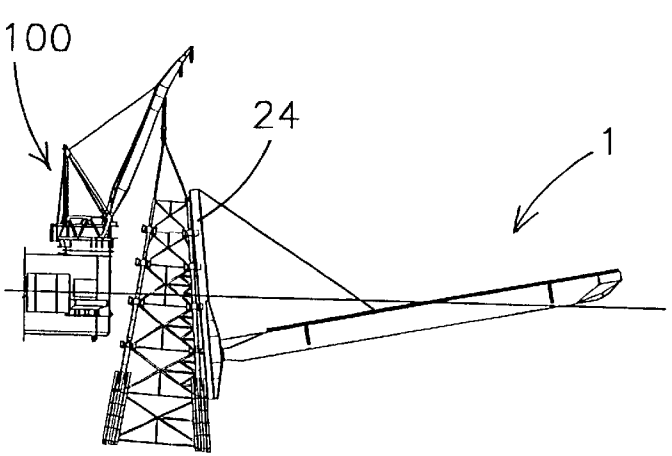
FIGS. 4–8 show, in a number of steps, the method for removing a structure which is erected underwater with the aid of a system in which the transport vessel is equipped with a first embodiment of the attachment means.
Figure 8:
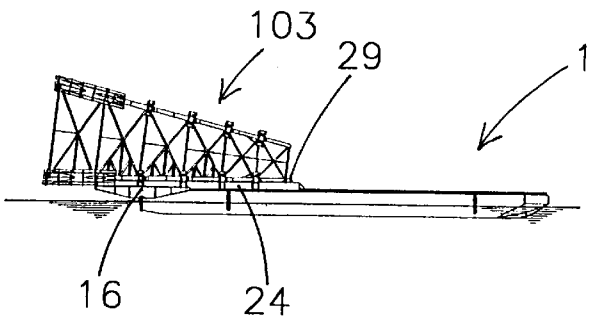

FIG. 8 shows a transport vessel 1 on which a substructure 103 of an offshore platform is transported in a horizontal transport position. The substructure 103 rests on extension bars 24 and is hooked into a suspension hook 29. In this case, the centre of gravity of the substructure 103 is beyond the stern, outside the pivot point of the attachment means 16, so that the tilting arms 17, 18 together with the substructure 103 automatically seeks to tilt towards an approximately vertical position. To ensure that this takes place in a controlled manner, a hauling cable 30 is used with, for example, a winch (not shown) with which the hauling cable 30 can be paid out (see FIG. 7). When the substructure 103 is in an approximately vertical position as shown in FIG. 6, it can be connected, by means of a hoisting cable 101, to a hoisting vessel 100. This hoisting vessel 100 is used to lift the substructure 103 out of the suspension hook 29, after which the transport vessel 1 is removed (FIGS. 4–5). The hoisting vessel 100 can then move the substructure 103 to the exact position where the substructure 103 is to be erected on the underwater bed. The method as described here with reference to a transport vessel provided with an embodiment of the attachment means as shown in FIGS. 4–8 may naturally also be used with the other embodiments which have been described.

The above text has described methods in which three separate embodiments of the attachment means are used. Naturally, still further embodiments of the attachment means or a combination of embodiments are conceivable in the method according to the invention.

The methods have been described by way of example with reference to the removal or positioning of a structure which has been or is to be positioned on an underwater bed. It will be obvious that the methods described can also be used for floating structures which are anchored to the underwater bed.

What is claimed is:

1. A method for removing a structure which is attached to an underwater bed, using a hoisting vessel provided with a hoisting mechanism for hoisting up the structure, and a transport vessel for transporting the structure, the transport vessel being provided with attachment means for attaching the structure in a substantially vertical position to the transport vessel and with tilting means for tilting the structure between the substantially vertical position and a substantially horizontal position, wherein the hoisting vessel and the transport vessel are separate vessels, said method comprising the steps of:

(i) detaching the structure from the underwater bed;

(ii) connecting the structure to the hoisting mechanism;

(iii) hoisting up the structure using the hoisting mechanism;

(iv) attaching the structure to the transport vessel in such a manner that it can tilt about a horizontal axis; and (v) tilting the structure into a substantially horizontal position.

2. The method according to claim 1, wherein said attachment means of said transport vessel comprises at least one tiltable arm which is able to at least partially support one side of the structure.

3. The method according to claim 2, wherein said at least one tiltable arm is provided with suspension means for suspending said structure.

4. The method according to claim 3, wherein said suspension means comprises a suspension hook for engaging above water on a top part of said structure.

5. The method according to claim 4, wherein said suspension means further comprises a bearing foot for engaging beneath a bottom part of said structure.

6. The method according to claim 3, wherein said suspension means comprises a bearing foot for engaging beneath a bottom part of said structure.

7. The method according to claim 2, wherein said attachment means further comprises at least a second tiltable arm for tilting said structure, said at least one tiltable arm supporting said structure during a first part of said tilting, and said at least one tiltable arm and said second tiltable arm support said structure together during a second part of said tilting.

8. The method according to claim 7, wherein said attachment means comprises cables which are attached to said vessel on the side of said at least one tiltable arm and said second tiltable arm and hang downwards from said vessel, which cables are provided, at ends thereof, with attachment members for attaching said structure to said cables.

9. A method for positioning a structure which is to be attached to an underwater bed, using a hoisting vessel provided with a hoisting mechanism for hoisting up the structure, and a transport vessel for transporting the structure, the transport vessel being provided with attachment means for attaching the structure in a substantially vertical position to the transport vessel and with tilting means for tilting the structure between the substantially vertical position and a substantially horizontal position, wherein the hoisting vessel and the transport vessel are separate vessels, said method comprising the steps of:

(i) transporting the structure using the transport vessel;

(ii) tilting the structure from a substantially horizontal transport position into a substantially vertical position, the structure being tiltably attached to the transport vessel;

(iii) connecting the structure to the hoisting mechanism;

(iv) detaching the structure from the transport vessel;

(v) lowering the structure using the hoisting mechanism; and (vi) detaching the structure from the hoisting mechanism.

10. The method according to claim 9, wherein said attachment means of said transport vessel comprises at least one tiltable arm which is able to at least partially support one side of the structure.

11. The method according to claim 10, wherein the tiltable arm is provided with suspension means for suspending the structure.

12. The method according to claim 11, wherein the suspension means comprises a suspension hook for engaging above water on a top part of the structure.

13. The method according to claim 12, wherein the suspension means further comprises a bearing foot for engaging beneath a bottom part of the structure.

14. The method according to claim 11, wherein the suspension means comprises a bearing foot for engaging beneath a bottom part of the structure.

15. The method according to claim 10, wherein the attachment means further comprises at least a second tiltable arm for tilting the structure, said at least one tiltable arm supporting the structure during a first part of said tilting, and said at least one tiltable arm and second set tilting arms together supporting the structure during a second part of said tilting.

16. The method according to claims 15, wherein the attachment means comprises cables which are attached to the vessel on the side of said at least one tiltable arm and said second tiltable arm hang downwards from said vessel, which cables are provided, at ends thereof, with attachment members for attaching said sure to said cables.

* * * * *